US007429957B1

(12) United States Patent
Tonn

(10) Patent No.: US 7,429,957 B1
(45) Date of Patent: Sep. 30, 2008

(54) WIDEBAND FLOATING WIRE ANTENNA USING A DOUBLE NEGATIVE META-MATERIAL

(75) Inventor: David A. Tonn, Charlestown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 54 days.

(21) Appl. No.: 11/713,832

(22) Filed: Feb. 20, 2007

(51) Int. Cl.
*H01Q 1/34* (2006.01)

(52) U.S. Cl. ..... 343/709

(58) Field of Classification Search ..... 343/709, 343/710, 719, 701; 340/984, 985; 114/312
See application file for complete search history.

(56) References Cited

U.S. PATENT DOCUMENTS 4,227,479 A * 10/1980 Gertler et al. ..... 114/312
4,774,519 A * 9/1988 Pease et al. ..... 343/709
4,962,488 A * 10/1990 Dell-Imagine et al. ..... 367/3
5,517,202 A * 5/1996 Patel et al. ..... 343/709
6,144,342 A * 11/2000 Bertheas et al. ..... 343/709
6,683,579 B1 * 1/2004 Riveria ..... 343/709
6,859,114 B2 2/2005 Eleftheriades et al.
6,907,839 B2 * 6/2005 Kruger et al. ..... 114/339
6,958,729 B1 * 10/2005 Metz ..... 343/700 MS
2004/0140945 A1 7/2004 Werner et al.
2006/0028385 A1 2/2006 Davis et al.

OTHER PUBLICATIONS

David A. Tonn and R. Bansal, Insulated Antenna With Metamaterial Coating Operating in Lossy Medium, Article, Apr. 27, 2006, vol. 42, No. 9, Electronic Letters, USA.

* cited by examiner

*Primary Examiner*—Huedung Cao Mancuso
(74) *Attorney, Agent, or Firm*—James M. Kasischke; Jean-Paul A. Nasser; Michael P. Stanley

(57) ABSTRACT

A buoyant cable antenna element is taught that employs a specific double-negative meta-material sheath with a negative permeability. The double-negative meta-material sheath is disposed over the insulated wire portion of the buoyant cable antenna element. The double-negative meta-material sheath enables a deliberate reduction in the antenna wire inductance to a zero value at a desired critical frequency. Reducing the antenna wire inductance to zero creates a traveling wave structure antenna having enhanced bandwidth.

3 Claims, 1 Drawing Sheet

WIDEBAND FLOATING WIRE ANTENNA USING A DOUBLE NEGATIVE META-MATERIAL

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The invention relates to underwater vehicle communications and is directed more particularly to a new form of floating wire also known as a buoyant cable antenna element suitable for underwater vehicle communications.

(2) Description of the Prior Art

A buoyant cable antenna consists of a straight insulated wire that is positively buoyant and designed to float to the ocean surface when released by a submerged underwater vessel. The wire may be either a solid or stranded copper conductor of uniform diameter along its length. It is often connected to the underwater vehicle by means of a standard coaxial transmission line at one end. The other end of the wire is terminated either in a shorting cap (to connect it to the ocean) or an insulating cap (to isolate it from the ocean.) The choice of cap is determined by the mode of operation that the operator wishes. The buoyant cable antenna is one of a host of submarine antennas currently in use that allow a submarine to perform electromagnetic communications while it is submerged.

Prior art antennas suffer from limited performance in the commercial high frequency (HF) band of 2 to 30 MHZ. This limited performance is due to the limited band width of the prior art antenna elements. It has become apparent that there is a need for a buoyant cable antenna element that can improve the bandwidth of the antenna in the HF band.

SUMMARY OF INVENTION

An object of the present invention is, therefore, to provide an improved buoyant cable antenna element with enhanced performance in the commercial HF band.

This objective is achieved by using a specific double-negative meta-material sheath with a negative permeability, to surround the insulated wire portion of the buoyant cable antenna element. A double-negative meta-material having a specific permeability is used in order to deliberately reduce the antenna wire inductance to a zero value at a desired critical frequency, thereby creating a traveling wave structure antenna having enhanced bandwidth.

The above and other features of the invention, including various novel details of construction and combinations of parts, will now be more particularly described with reference to the accompanying drawings and pointed out in the claims. It will be understood that the particular assembly embodying the invention is shown by way of illustration only and not as a limitation of the invention. The principles and features of this invention may be employed in various and numerous embodiments without departing from the scope of the invention.

BRIEF DESCRIPTION OF THE DRAWING

Reference is made to the accompanying drawing in which is shown an illustrative embodiment of the invention from which its novel features and advantages will be apparent, and wherein.

DETAILED DESCRIPTION OF THE INVENTION

Figure 1:
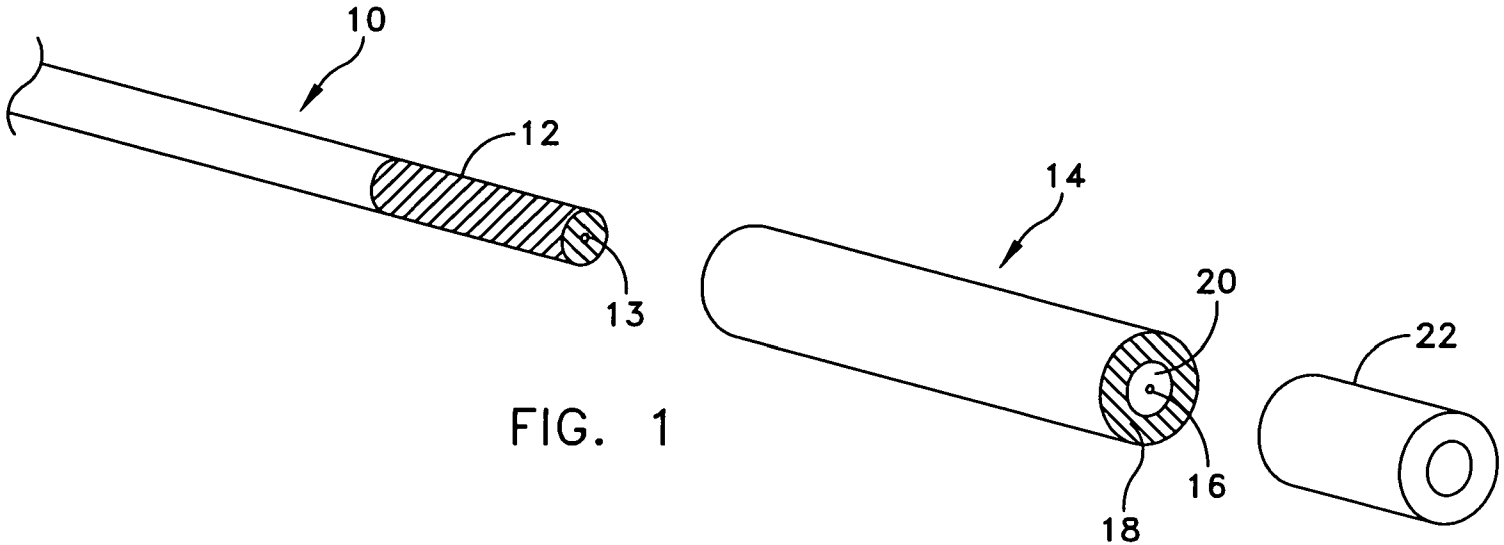
FIG. 1 is an exploded view of the buoyant cable antenna element.

Referring to FIG. 1, there is illustrated an exploded view of the present invention. Using the geometry of prior art buoyant cable antennas as a point of departure there is illustrated a coaxial feed line 10. The coaxial feed line 10 is a standard 50 ohm transmission line, however, the invention is not limited to use with a 50 ohm transmission lines. At the end of the coaxial feed line 10 the braid 12 is exposed for 3 to 4 inches. This is necessary in order to ground the feed system for the antenna. At the end of the section of exposed braid 12 the center conductor 13 of coaxial feed line 10 is connected to the antenna element 14. The antenna element 14 is designed to be positively buoyant and to float on the surface of a body of water. The antenna element 14 consist of a straight wire 16, usually a copper (or other metal) conductor of uniform diameter along its length. The straight wire 16 may be either a solid or stranded copper conductor. The antenna element 14 has a cylindrical sheath of a double-negative (DNG) meta-material 18 disposed over a cylindrical sheath of dielectric insulator 20 surrounding the straight wire 16. The sheath of double negative meta-material 18 is a non-conducting material whose dielectric constant and relative permeability are both negative numbers over a particular frequency range of interest. Meta-materials are a broad class of materials for applications in electromagnetics, antennas, and radio frequency component design and are well known in the art. At the end of antenna element 14 is a shorting cap 22. The shorting cap 22 is a solid metallic structure that connects electrically to the center conductor of the antenna element 14 and conforms to the overall diameter of the antenna element 14.

Figure 2:
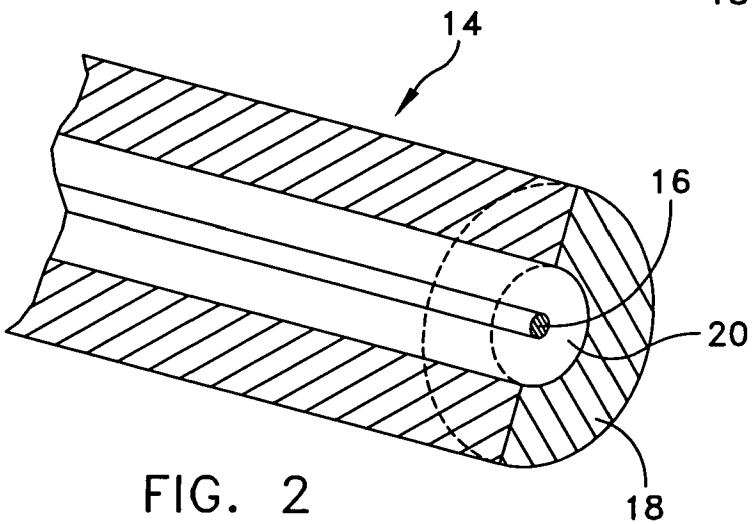
FIG. 2 is a detailed illustration of the components of the insulated wire antenna portion of the buoyant cable antenna element.

Referring to FIG. 2, there is illustrated a more detailed view of antenna element 14, which consists of a straight wire 16 surrounded by two concentric cylinders of material. The inner cylinder is composed of a conventional dielectric insulating material 20, such as Teflon or polyethylene. The outer cylinder is composed of the double negative meta-material 18, the material parameters of which are determined by the frequency range over which the antenna element 14 is to be used. There are no air gaps between the straight wire 16 and the dielectric cylinder 20, or between the dielectric cylinder 20 and meta-material cylinder 18. In a preferred embodiment, the meta-material 18 is buoyant in water.

In operation, the buoyant cable antenna of this invention works by exploiting the negative properties of the meta-material cylinder 18 to alter the propagation constant along the straight wire 16. A transmission line model is a suitable one for predicting the input impedance of a typical floating wire antenna. Applying this approach, it can be shown that the per-unit length inductance of the straight wire 16 is given by equation (1) as follows:

$$L = \frac{\mu_0}{8\pi} + \frac{\mu_0}{2\pi}\left[\mu_0 \ln\frac{b}{a} + \mu_2 \ln\frac{c}{b} + \mu_0 \ln\left(\frac{2}{\gamma_{Euler} c\sqrt{\omega\mu_0\sigma_{ocean}}}\right)\right] \quad (1)$$

Here a, b, and c, are the outer radii of the antenna wire 16, the dielectric cylinder 20, and the double-negative (DNG) meta-material cylinder 18, respectively, $\mu_2$ is the permeability of the meta-material cylinder 18, $\mu_0$ is the permeability of free space, $\sigma_{ocean}$ is the electrical conductivity of the ocean, and $\gamma_{Euler}$ is Euler's constant (approximately 1.781). ω is the angular frequency in radians/section and is equal to 2ωf where f is the frequency in Hertz. The per unit length capacitance C of the straight wire 16 is fixed (i.e., independent of frequency quantity) as shown by equation (2):

$$C = \frac{1}{\frac{1}{\varepsilon_1}\ln\frac{a}{b} + \frac{1}{\varepsilon_2}\ln\frac{b}{c}} \quad (2)$$

where the ϵ terms $\epsilon_1$ and $\epsilon_2$ are the permittivities of the dielectric cylinder 20 and meta-material cylinder 18, respectively. The characteristic impedance Z of the straight wire 16 and propagation constant γ along its axis are given by equations (3) and (4) respectively:

$$Z = \sqrt{\frac{R + j\omega L}{j\omega C}} \quad (3)$$

$$\gamma = \sqrt{(R + j\omega L) j\omega C} \quad (4)$$

where R is the sum of the bulk electrical resistance of the straight wire 16 and it radiation resistance, both on a per-unit-length basis. Here j is basic imaginary unit (the square root of −1,) and ω is the angular frequency previously defined. Using this formulation, a simple transmission line transformation allows the input impedance of the antenna element 14 to be determined given the length of the straight wire 16 and the impedance of the termination cap 22, which can be either shorted or open circuited.

The present invention operates by manipulating the inductance term L of the straight wire 16. In equation (1), the inductance L is frequency dependent. The last term of equation (1), $$\left[\mu_0 \ln\frac{b}{a} + \mu_2 \ln\frac{c}{b} + \mu_0 \ln\left(\frac{2}{\gamma_{Euler} c\sqrt{\omega\mu_0\sigma_{ocean}}}\right)\right],$$

decreases with increasing frequency. If $\mu_2$ is negative (which it is for a double negative meta-material) then there can exist some critical frequency at which the inductance L of straight wire 16 is zero. When this happens, equations (3) and (4) indicate that the propagation constant γ picks up a strong attenuation term, meaning that the straight wire 16 now carries a diminishing traveling wave of current instead of a standing wave, as prior art floating wire or buoyant cable antennas do. By designing the antenna element 14 to be a traveling wave structure there will be improvement in the antenna element bandwidth over a standing wave structure. There will also be performance independent of the type of termination used on the antenna. (i.e., the antenna will have approximately the same gain and bandwidth regardless of whether an open or short circuit termination is used), a further improvement over the prior art buoyant cable antenna where the type of termination used has a very strong effect on the gain and bandwidth of the antenna.

In practice, a wire, 100 feet long made of standard #16 AWG copper was used to demonstrate the increased bandwidth. The inner dielectric enclosing the wire was 0.325 inches in radius and had a dielectric constant of 1.8. The L=0 critical frequency was arbitrarily chosen to be 17 MHz (roughly mid-band). This frequency dictated the use of a meta-material with a $\mu_2$ of −5.475. The permittivity of the meta-material had been arbitrarily chosen to be −2.2. It is of great interest to note that for a frequency of f>7 MHz, the input impedances seen with either a short or open circuited tip are almost identical. This indicates that the current leaving the coaxial feed line is attenuated as it travels along the wire to such an extent that there is little current left at the end of the antenna to reflect backwards and create a standing wave. It is also worth noting that the impedance does not change appreciably with increasing frequency.

There is thus provided a buoyant cable antenna that can improve the bandwidth of the antenna in the HF band through the use of a DNG meta-material sheath.

It will be understood that many additional changes in the details, materials, and arrangements of parts, which have been herein described and illustrated in order to explain the nature of the invention, may be made by those skilled in the art within the principles and scope of the invention as expressed in the appended claims.

What is claimed is:

1. A buoyant cable antenna for use with an underwater vehicle comprising:

a coaxial feed line having a first end and a second end, said first end being joined to said underwater vehicle, wherein said coaxial feed line serves as a transmission line;

an exposed braid of coaxial feed line having a first end and a second end, wherein said first end of said exposed braid of coaxial feed line is joined to the second end of the coaxial feed line;

an antenna element that is positively buoyant in a body of water, having a first end and a second end wherein said first end of said antenna element is joined to said second end of said exposed braid of coaxial feed line, said antenna element further comprising:

a straight wire of conducting metal of uniform diameter along its length;

a cylindrical sheath of dielectric material surrounding said straight wire, wherein said cylindrical sheath of dielectric material serves to insulate said straight wire;

a cylindrical sheath of a double-negative meta-material surrounding said cylindrical sheath of dielectric material, wherein said cylindrical sheath of double negative meta-material is a non-conducting material whose dielectric constant and relative permeability are both negative numbers over a specific frequency range; and a shorting cap joined to the second end of said antenna element, wherein said shorting cap is a solid metallic structure that connects electrically to the center conductor of the antenna and conforms to the overall diameter of the antenna;

wherein the cylindrical sheath of double-negative meta-material has a specific negative permeability value directly related to a desired critical frequency such that the inductance of said straight wire is reduced to zero at said desired critical frequency, which in turn creates a traveling wave of current along said straight wire.

2. The apparatus of claim 1 wherein there are no air gaps between the straight wire and the cylindrical sheath of dielectric material and the cylindrical sheath of double-negative meta-material.

3. The apparatus of claim 1 wherein the per-unit length inductance of said straight wire can be expressed as:

$$L = \frac{\mu_0}{8\pi} + \frac{\mu_0}{2\pi}\left[\mu_0 \ln\frac{b}{a} + \mu_2 \ln\frac{c}{b} + \mu_0 \ln\left(\frac{2}{\gamma_{Euler} c\sqrt{\omega\mu_0\sigma_{ocean}}}\right)\right],$$

wherein a, b, and c, are the outer radii of said straight wire, the cylindrical sheath of dielectric material and the cylindrical sheath of double-negative (DNG) meta-material, respectively, $\mu_2$ is the permeability of the cylindrical sheath of double-negative meta-material, $\mu_0$ is the permeability of free space, $\sigma_{ocean}$ is the electrical conductivity of the ocean, and $\gamma_{Euler}$ is Euler's constant (approximately 1.781), wherein the last term of said equation $$\left[\mu_0 \ln\frac{b}{a} + \mu_2 \ln\frac{c}{b} + \mu_0 \ln\left(\frac{2}{\gamma_{Euler} c\sqrt{\omega\mu_0\sigma_{ocean}}}\right)\right]$$

decreases with increasing frequency such that when $\mu_2$ is negative then there can exist a critical frequency at which said inductance L of said straight wire is zero.

* * * * *